US006963838B1

(12) United States Patent
Christfort

(10) Patent No.: US 6,963,838 B1
(45) Date of Patent: Nov. 8, 2005

(54) ADAPTIVE HOSTED TEXT TO SPEECH PROCESSING

(75) Inventor: Jacob Christfort, San Francisco, CA (US)

(73) Assignee: Oracle International Corporation, Redwood Shores, CA (US)

( * ) Notice: Subject to any disclaimer, the term of this patent is extended or adjusted under 35 U.S.C. 154(b) by 929 days.

(21) Appl. No.: 09/705,433

(22) Filed: Nov. 3, 2000

(51) Int. Cl.[7] ..... G10L 13/08; G10L 13/00; G10L 21/00

(52) U.S. Cl. ..... 704/260; 704/258; 704/270

(58) Field of Search ..... 704/260, 270, 704/275

(56) References Cited

U.S. PATENT DOCUMENTS

| | | | | |
|---|---|---|---|---|
| 5,592,585 | A * | 1/1997 | Van Coile et al. | 704/206 |
| 5,727,120 | A * | 3/1998 | Van Coile et al. | 704/206 |
| 6,052,664 | A * | 4/2000 | Van Coile et al. | 704/260 |
| 6,175,821 | B1 * | 1/2001 | Page et al. | 704/258 |
| 6,496,801 | B1 * | 12/2002 | Veprek et al. | 704/260 |
| 6,535,854 | B2 * | 3/2003 | Buchner et al. | 704/275 |
| 2002/0010584 | A1 * | 1/2002 | Schultz et al. | 704/270 |
| 2003/0028378 | A1 * | 2/2003 | August et al. | 704/260 |

* cited by examiner

*Primary Examiner*—Angela A. Armstrong
(74) *Attorney, Agent, or Firm*—Hickman Palermo Truong & Becker, LLP; Christopher J. Brokaw

(57) ABSTRACT

Techniques are provided performing text-to-speech translation in situations in which the input texts may contain unanticipated content. According to one aspect of the invention, text-to-speech services are provided by splitting a text into segments that include anticipated-content segments and unanticipated-content segments. Speech for the anticipated-content segments is generated based on pre-recorded sound recordings that correspond to the anticipated-content segments. Speech for the unanticipated-content segments is generated using speech synthesis. Usage statistics are recorded. The usage statistics identify which segments are contained in texts that are translated using the text-to-speech services. In one embodiment, the usage statistics indicate frequency of use of unanticipated-content segments and, based on the usage statistics, a set of unanticipated-content segments for which to make recordings is selected. In another embodiment, the usage statistics indicate frequency of use of anticipated-content segments, and a set of anticipated-content segments is selected based on the usage statistics. The recordings associated with the selected anticipated-content segments are then removed.

22 Claims, 2 Drawing Sheets

ADAPTIVE HOSTED TEXT TO SPEECH PROCESSING

FIELD OF THE INVENTION

The present invention relates to speech processing and, more specifically to adaptive hosted text to speech processing.

BACKGROUND OF THE INVENTION

Humans learn information in a variety of ways. Two of the most common ways to learn information are reading text and listening to speech. In many situations, it is desirable to convert into audible speech information that is stored as written text. For example, a parent may read a bedtime story to a child. In certain applications, it is not practical to employ live humans to read a text out loud every time anyone wants to hear the information contained in the text. One approach for handling such situations is to record a human reading the text out loud, and then play back the recording every time someone wants to hear the information contained in the text. This approach is used, for example, to create audio recordings of books.

Unfortunately, even creating recordings of texts is not practical for many applications. For example, a news company may desire to have all of its news stories available as audible speech as well as written text. However, the volume of news stories may make it impractical to have someone read and record all of them. The cost of recording the full-text readings becomes impractically high in many modern applications, such as services that present as audible speech information from thousands or millions of electronic sources of textual information, such as web pages on the World Wide Web.

For applications where full-text readings are impractical, it is possible to store partial-text readings and then combine the partial-texts readings during playback. For example, a human can record the reading of every word in a dictionary, and playback the single-word recordings in the sequence that the words appear in a text. However, this only works when the reader can anticipate every word or phrase in the text. As a practical matter, it is impossible to pre-record all possible words and phrases without knowing the exact content of the texts involved. Thus, the partial-text reading technique works well when the content of all texts involved is known ahead of time, but does not work when it is not.

When the exact content of texts is not known ahead of time, the text is said to contain "unanticipated content". One approach to providing text-to-speech service for texts that may contain unanticipated content involves the use of a "synthesized voice". A synthesized voice is produced by programming a device (not an actual human) to pronounce words contained within an input text based on a complex set of pronunciation rules. Unfortunately, even the most sophisticated voice synthesis techniques produce "readings" of notoriously poor quality that many listeners find unacceptable.

Based on the foregoing, it is clearly desirable to provide improved text-to-speech techniques. In particular, it is desirable to provide improved text-to-speech techniques for situations in which the input texts may contain unanticipated content.

SUMMARY OF THE INVENTION

Techniques are provided performing text-to-speech translation in situations in which the input texts may contain unanticipated content. According to one aspect of the invention, text-to-speech services are provided by splitting a text into segments that include anticipated-content segments and unanticipated-content segments. Speech for the anticipated-content segments is generated based on pre-recorded sound recordings that correspond to the anticipated-content segments. Speech for the unanticipated-content segments is generated using speech synthesis.

According to another aspect of the invention, usage statistics are recorded. The usage statistics identify which segments are contained in texts that are translated using the text-to-speech services. In one embodiment, the usage statistics indicate frequency of use of unanticipated-content segments and, based on the usage statistics, a set of unanticipated-content segments for which to make recordings is selected. In another embodiment, the usage statistics indicate frequency of use of anticipated-content segments, and a set of anticipated-content segments is selected based on the usage statistics. The recordings associated with the selected anticipated-content segments are then removed.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION OF THE PREFERRED EMBODIMENT

Techniques are provided performing text-to-speech translation in situations in which the input texts may contain unanticipated content. In the following description, for the purposes of explanation, numerous specific details are set forth in order to provide a thorough understanding of the present invention. It will be apparent, however, to one skilled in the art that the present invention may be practiced without these specific details. In other instances, well-known structures and devices are shown in block diagram form in order to avoid unnecessarily obscuring the present invention.

System Overview

Figure 1:
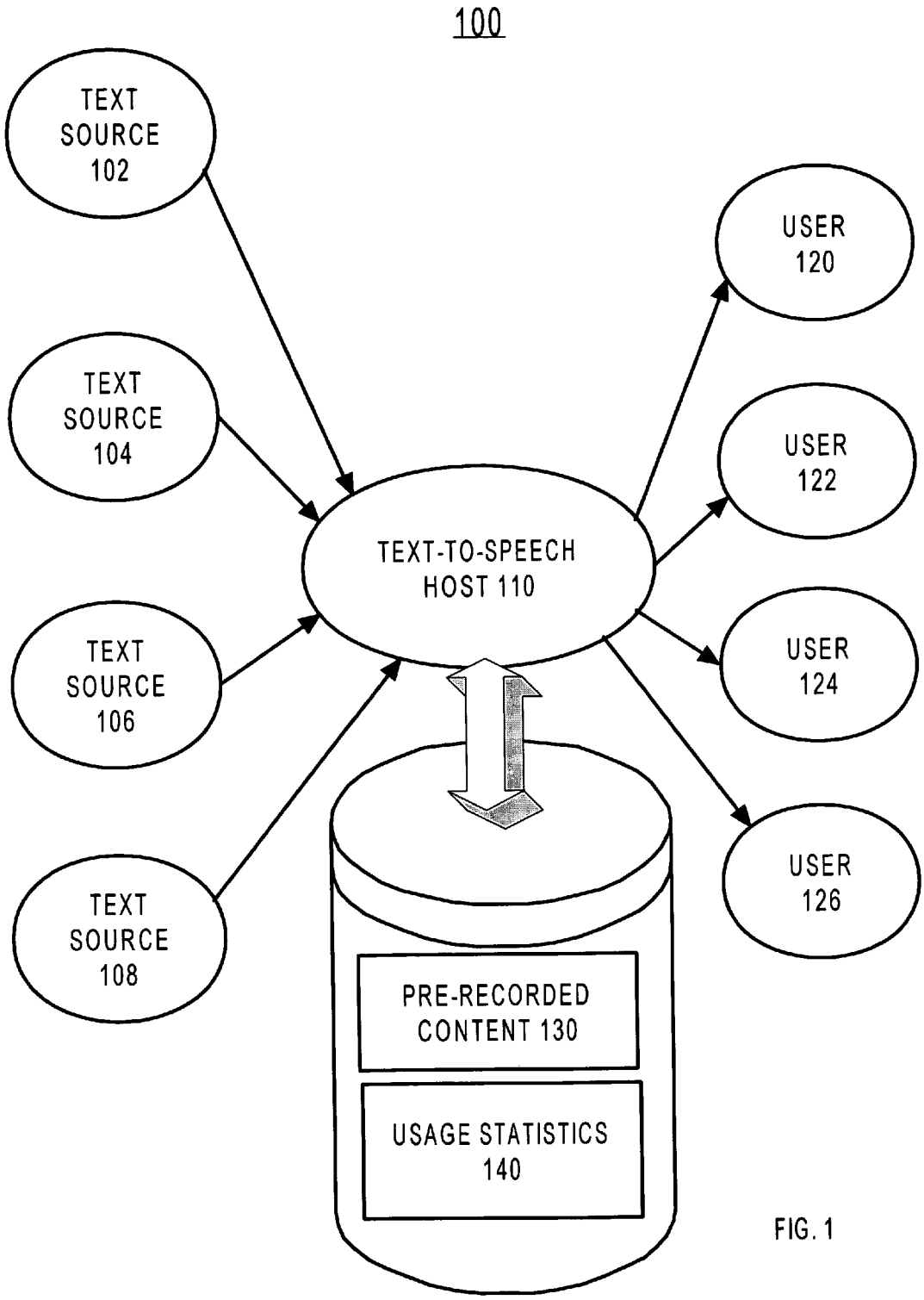
FIG. 1 is a block diagram of a system configured according to an embodiment of the invention.

Referring to FIG. 1, it is a block diagram of a system 100 in which the techniques described herein may be employed. System 100 includes a plurality of text sources 102–108, a plurality of users 120–126, and a text-to-speech host 110.

Text sources 102–108 generally represent any type of source of any type of text. For example, in the context of the World Wide Web, text sources 102–108 may be web pages that include text. Alternatively, texts sources 102–108 may represent electronic versions of books. Text sources 102–108 may be stored together and controlled by a single party, or may be stored separately and controlled by many parties. The present invention is not limited to any particular type of textual source, or any particular storage or control arrangement.

Text-to-speech host 110 generally represents the host of a service for providing users with audible speech of text sources 102–108. Text-to-speech host 110 may be the owner of text sources 102–108, or may be a third party completely separate from the owners and/or producers of text sources 102–108. For example, text sources 102–108 may represent text contained in web pages throughout the World Wide Web, while text-to-speech host 110 is a service, connected to the World Wide Web, that provides the services of converting to audible speech the text of web pages specified by users.

Users 120–126 generally represent the entities that desire audible speech versions of text sources 102–108. Users 120–126 may be, for example, humans that place telephone calls to text-to-speech host 110 to have content contained in text sources 102–108 read to them over the telephone. Alternatively, users 120–126 may be computer processes that process speech input. Users 120–126 may also be humans that desire to have their email read to them over the telephone, where text sources 102–108 represent their email. The present invention is not limited to any particular type of audible speech recipient.

Functional Overview

According to one embodiment, text-to-speech host 110 employs a technique that combines the best of the partial-text recording and voice synthesis techniques described above. In particular, text-to-speech host 110 maintains pre-recorded content 130 of frequently used words and phrases. The pre-recorded content 130 may be maintained, for example, as pre-recorded sound files in a database.

Whenever text-to-speech host 110 is asked to translate text to speech, host 110 splits the text into segments. The resulting segments generally include anticipated-content segments and unanticipated-content segments. The anticipated-content segments are segments that correspond to pre-recorded content 130. The unanticipated-content segments are segments that have no corresponding pre-recorded content 130.

After splitting the text input segments, text-to-speech host 110 translates the text to speech by playing back the pre-recorded content 130 for the anticipated-content segments, and converting the unanticipated-content segments to speech using voice synthesis techniques.

Adaptive Text-to-Speech Techniques

In general, pre-recorded speech is easier to understand and preferable to voice synthesis speech. Therefore, according to one aspect of the invention, text-to-speech host 110 employs adaptive techniques to increase the percentage of speech output that is covered by pre-recorded content 130.

According to one embodiment, text-to-speech host 110 maintains usage statistics 140. Usage statistics 140 generally represent information about how users are using text-to-speech host 110. Usage statistics 140 may include, for example, data that identifies the unanticipated-content segments that have been translated within a particular time period, and the frequency at which each of the unanticipated-content segments was translated.

According to one embodiment, a set of unanticipated-content segments is periodically selected based on the usage statistics 140. For example, the usage statistics 140 may be used to identify and select the unanticipated-content segments that were most frequently requested during the most recent time period. The unanticipated-content segments thus selected are then presented to a speech recorder ("voice"). The voice then records the words and/or phrases that correspond to the selected unanticipated-content segments, and stores the recordings along with the existing pre-recorded content 130.

Consequently, when those words or phrases are encountered in text that is subsequently requested, those words and phrases will correspond to pre-recorded content 130, and therefore will be processed as anticipated-content segments rather than unanticipated-content segments. Specifically, the text-to-speech host 110 will play back the newly-recorded sound files for those segments, rather than translating them using speech synthesis.

This process may be repeated continuously, thereby constantly increasing the quality of the speech produced by text-to-speech host 110. For example, each morning a person may record the ten most frequently translated unanticipated-content segments of the previous day. Because the segments that are translated are those most frequently encountered, the relatively high-cost resource of human effort is used to its greatest efficacy.

Discarding Pre-Recorded Content

According to one embodiment, usage statistics 130 are also used to determine pre-recorded content 130 to be discarded. For example, text-to-speech host 110 may record as part of usage statistics 140 the frequency with which pre-recorded content 130 is accessed. If the frequency with which a particular segment of pre-recorded content 130 drops below a predetermined level, the text-to-speech host 110 may automatically discard that segment, thus making available more storage space for new pre-recorded content 130.

Content-Based Selection

According to another aspect of the invention, more than one recording may be stored for a particular segment of text. For example, the word "cool" may correspond to two recordings, one that pronounces the word as is conventional in the context of temperature, the other of which pronounces the word as is conventional when used as slang. According to one embodiment, for each text segment that has more than one recording, rules are provided for selecting which recording to use in a given context. When the text-to-host 110 encounters a segment for which there is more than one recording, the text-to-host 110 selects one of the recordings based on the rules associated with that segment, and uses the selected recording to translate the segment to audible speech.

The rules may select the appropriate recording, for example, based at least in part on the textual context in which the segment resides. For example, a rule may specify that the "temperature" pronunciation of the word "cool" is to be used when the word "cool" appears in a paragraph that also includes the word "temperature".

Other factors that may be used to determine which recording to use may include, for example, the source of the text. Thus, if the source of the text is a weather service, than the "temperature" pronunciation of the word "cool" may be selected regardless of the words surrounding it.

News Service Example

The techniques described herein are particularly beneficial for environments in which a host performs text-to-speech translation for text that originates from a variety of outside sources. For example, text-to-speech host 110 may provide text-to-speech translations for a variety of news services. Due to the nature of current news, certain words that are rarely used may, for short periods of time, be used with a very high frequency. For example, the word "Kurst" is the name of a sunken Russian submarine. Prior to the sinking, the word would probably have never shown up in the text from the news sources. However, for the several weeks that followed the sinking, the word "Kurst" would appear in the news text with great frequency.

Using the adaptive techniques described herein, the word "Kurst" would, shortly after the sinking, be selected as one of the most frequently encountered unanticipated-content segments. In response, a recording of the word would be stored with pre-recorded content 130. Consequently, the pre-recording would be used in all subsequent text-to-speech translations of the word during the following weeks. Eventually, the Kurst would cease to be mentioned in the news, and the recording of "Kurst" would be identified as a least frequently used recording. The "Kurst" recording would then be deleted to free up storage space.

Hardware Overview

Figure 2:
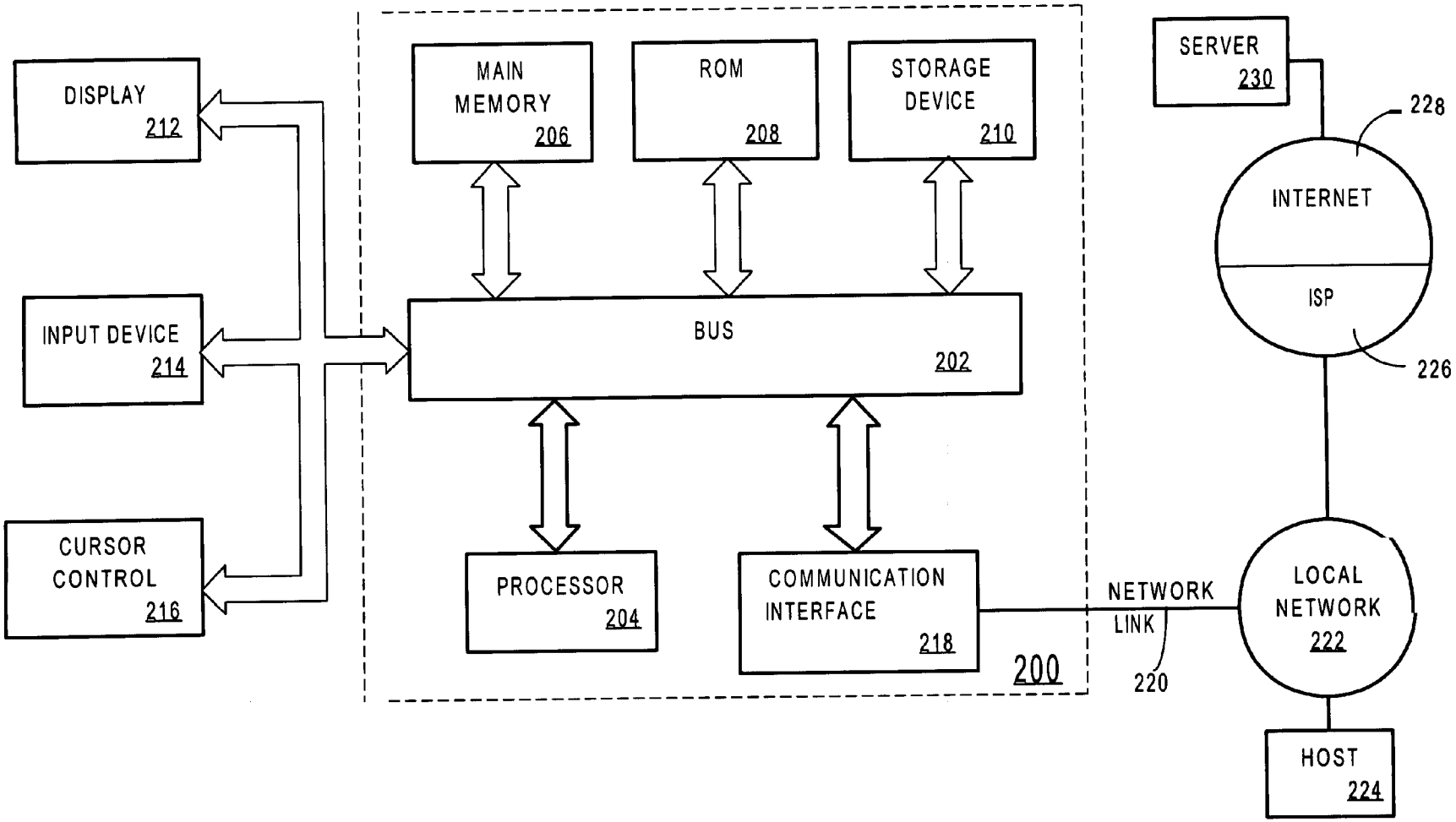
FIG. 2 is a block diagram of a computer system upon which embodiments of the invention may be implemented.

FIG. 2 is a block diagram that illustrates a computer system 200 upon which an embodiment of the invention may be implemented. Computer system 200 includes a bus 202 or other communication mechanism for communicating information, and a processor 204 coupled with bus 202 for processing information. Computer system 200 also includes a main memory 206, such as a random access memory (RAM) or other dynamic storage device, coupled to bus 202 for storing information and instructions to be executed by processor 204. Main memory 206 also may be used for storing temporary variables or other intermediate information during execution of instructions to be executed by processor 204. Computer system 200 further includes a read only memory (ROM) 208 or other static storage device coupled to bus 202 for storing static information and instructions for processor 204. A storage device 210, such as a magnetic disk or optical disk, is provided and coupled to bus 202 for storing information and instructions.

Computer system 200 may be coupled via bus 202 to a display 212, such as a cathode ray tube (CRT), for displaying information to a computer user. An input device 214, including alphanumeric and other keys, is coupled to bus 202 for communicating information and command selections to processor 204. Another type of user input device is cursor control 216, such as a mouse, a trackball, or cursor direction keys for communicating direction information and command selections to processor 204 and for controlling cursor movement on display 212. This input device typically has two degrees of freedom in two axes, a first axis (e.g., x) and a second axis (e.g., y), that allows the device to specify positions in a plane.

The invention is related to the use of computer system 200 for implementing the techniques described herein. According to one embodiment of the invention, those techniques are performed by computer system 200 in response to processor 204 executing one or more sequences of one or more instructions contained in main memory 206. Such instructions may be read into main memory 206 from another computer-readable medium, such as storage device 210. Execution of the sequences of instructions contained in main memory 206 causes processor 204 to perform the process steps described herein. In alternative embodiments, hard-wired circuitry may be used in place of or in combination with software instructions to implement the invention. Thus, embodiments of the invention are not limited to any specific combination of hardware circuitry and software.

The term "computer-readable medium" as used herein refers to any medium that participates in providing instructions to processor 204 for execution. Such a medium may take many forms, including but not limited to, non-volatile media, volatile media, and transmission media. Non-volatile media includes, for example, optical or magnetic disks, such as storage device 210. Volatile media includes dynamic memory, such as main memory 206. Transmission media includes coaxial cables, copper wire and fiber optics, including the wires that comprise bus 202. Transmission media can also take the form of acoustic or light waves, such as those generated during radio-wave and infra-red data communications.

Common forms of computer-readable media include, for example, a floppy disk, a flexible disk, hard disk, magnetic tape, or any other magnetic medium, a CD-ROM, any other optical medium, punchcards, papertape, any other physical medium with patterns of holes, a RAM, a PROM, and EPROM, a FLASH-EPROM, any other memory chip or cartridge, a carrier wave as described hereinafter, or any other medium from which a computer can read.

Various forms of computer readable media may be involved in carrying one or more sequences of one or more instructions to processor 204 for execution. For example, the instructions may initially be carried on a magnetic disk of a remote computer. The remote computer can load the instructions into its dynamic memory and send the instructions over a telephone line using a modem. A modem local to computer system 200 can receive the data on the telephone line and use an infra-red transmitter to convert the data to an infra-red signal. An infra-red detector can receive the data carried in the infra-red signal and appropriate circuitry can place the data on bus 202. Bus 202 carries the data to main memory 206, from which processor 204 retrieves and executes the instructions. The instructions received by main memory 206 may optionally be stored on storage device 210 either before or after execution by processor 204.

Computer system 200 also includes a communication interface 218 coupled to bus 202. Communication interface 218 provides a two-way data communication coupling to a network link 220 that is connected to a local network 222. For example, communication interface 218 may be an integrated services digital network (ISDN) card or a modem to provide a data communication connection to a corresponding type of telephone line. As another example, communication interface 218 may be a local area network (LAN) card to provide a data communication connection to a compatible LAN. Wireless links may also be implemented. In any such implementation, communication interface 218 sends and receives electrical, electromagnetic or optical signals that carry digital data streams representing various types of information.

Network link 220 typically provides data communication through one or more networks to other data devices. For example, network link 220 may provide a connection through local network 222 to a host computer 224 or to data equipment operated by an Internet Service Provider (ISP) 226. ISP 226 in turn provides data communication services through the world wide packet data communication network now commonly referred to as the "Internet" 228. Local network 222 and Internet 228 both use electrical, electromagnetic or optical signals that carry digital data streams. The signals through the various networks and the signals on network link 220 and through communication interface 218, which carry the digital data to and from computer system 200, are exemplary forms of carrier waves transporting the information.

Computer system 200 can send messages and receive data, including program code, through the network(s), network link 220 and communication interface 218. In the Internet example, a server 230 might transmit a requested code for an application program through Internet 228, ISP 226, local network 222 and communication interface 218.

The received code may be executed by processor 204 as it is received, and/or stored in storage device 210, or other non-volatile storage for later execution. In this manner, computer system 200 may obtain application code in the form of a carrier wave.

In the foregoing specification, the invention has been described with reference to specific embodiments thereof. It will, however, be evident that various modifications and changes may be made thereto without departing from the broader spirit and scope of the invention. The specification and drawings are, accordingly, to be regarded in an illustrative rather than a restrictive sense.

What is claimed is:

1. A method of providing text-to-speech services, the method comprising the steps of:

splitting a text into segments that include anticipated-content segments and unanticipated-content segments, wherein each of the anticipated-content segments have previously satisfied criteria for being pre-recorded, and wherein each of the unanticipated-content segments are not within the anticipated-content segments;

generating speech for said anticipated-content segments based on pre-recorded sound recordings that correspond to said anticipated-content segments;

generating speech for said unanticipated-content segments using speech synthesis;

monitoring usage of a particular segment of said segments by said text-to-speech services, wherein said particular segment is one of an anticipated-content-segment and an unanticipated-content-segment; and based on the usage of said particular segment by said text-to-speech services, recategorizing said particular segment to the other of said anticipated-content-segment and said unanticipated-content-segment.

2. The method of claim 1 comprising the steps of storing usage statistics that identify which segments are contained in texts that are translated using said text-to-speech services.

3. The method of claim 2 wherein the usage statistics indicate frequency of use of at least a set of said segments.

4. The method of claim 3 wherein:

the usage statistics indicate frequency of use of unanticipated-content segments; and the method includes the step of selecting, based on said usage statistics, a set of unanticipated-content segments for which to make recordings.

5. The method of claim 4 wherein the step of selecting a set of unanticipated-content segments includes selecting a set of unanticipated-content segments that were most frequently used during a time period.

6. The method of claim 3 wherein:

the usage statistics indicate frequency of use of anticipated-content segments; and the method includes the steps of selecting a set of anticipated-content segments based on said usage statistics; and removing recordings associated with the selected anticipated-content segments.

7. The method of claim 6 wherein the step of selecting a set of anticipated-content segments includes selecting a set of anticipated-content segments that were least frequently used during a period of time.

8. The method of claim 1 further comprising the steps of:

recording a plurality of recordings for a particular anticipated-segment;

storing data that indicates rules for selecting between said plurality of recordings; and when said text contains said particular anticipated-content segment, applying the rules indicated in said data to select one of said plurality of recordings; and generating speech for said particular anticipated-segment using said selected recording.

9. The method of claim 8 wherein:

the text is from a particular source; and the step of applying the rules includes determining which of said plurality of recordings to select based at least in part on identity of said particular source.

10. The method of claim 1 wherein:

the text is from one of a plurality of text sources managed by a plurality of parties; and the text-to-speech services are provided by a host, separate from said plurality of parties, that is connected to said text sources over a network system.

11. The method of claim 10 wherein the text sources are web pages that contain text, and said network system is the World Wide Web.

12. The method of claim 8 wherein:

the particular anticipated-content segment appears in a particular context within said text; and the step of applying the rules includes determining which of said plurality of recordings to select based at least in part on said particular context.

13. A computer-readable medium carrying instructions for providing text-to-speech services, the instructions including instructions for performing the steps of:

splitting a text into segments that include anticipated-content segments and unanticipated-content segments, wherein each of the anticipated-content segments have previously satisfied criteria for being pre-recorded, and wherein each of the unanticipated-content segments are not within the anticipated-content segments;

generating speech for said anticipated-content segments based on pre-recorded sound recordings that correspond to said anticipated-content segments;

generating speech for said unanticipated-content segments using speech synthesis, monitoring usage of a particular segment of said segments by said text-to-speech services, wherein said particular segment is one of an anticipated-content-segment and an unanticipated-content-segment; and based on the usage of said particular segment by said text-to-speech services, recategorizing said particular segment to the other of said anticipated-content-segment and said unanticipated-content-segment.

14. The computer-readable medium of claim 13 comprising the steps of storing usage statistics that identify which segments are contained in texts that are translated using said text-to-speech services.

15. The computer-readable medium of claim 14 wherein the usage statistics indicate frequency of use of at least a set of said segments.

16. The computer-readable medium of claim 15 wherein:

the usage statistics indicate frequency of use of unanticipated-content segments; and the computer-readable medium includes the step of selecting, based on said usage statistics, a set of unanticipated-content segments for which to make recordings.

17. The computer-readable medium of claim 16 wherein the step of selecting a set of unanticipated-content segments includes selecting a set of unanticipated-content segments that were most frequently used during a time period.

18. The computer-readable medium of claim 15 wherein:

the usage statistics indicate frequency of use of anticipated-content segments; and the computer-readable medium includes the steps of selecting a set of anticipated-content segments based on said usage statistics; and removing recordings associated with the selected anticipated-content segments.

19. The computer-readable medium of claim 18 wherein the step of selecting a set of anticipated-content segments includes selecting a set of anticipated-content segments that were least frequently used during a period of time.

20. The computer-readable medium of claim 13 further comprising the steps of:

recording a plurality of recordings for a particular anticipated-segment;

storing data that indicates rules for selecting between said plurality of recordings; and when said text contains said particular anticipated-content segment, applying the rules indicated in said data to select one of said plurality of recordings; and generating speech for said particular anticipated-segment using said selected recording.

21. The computer-readable medium of claim 20 wherein:

the text is from a particular source; and the step of applying the rules includes determining which of said plurality of recordings to select based at least in part on identity of said particular source.

22. The computer-readable medium of claim 20 wherein:

the particular anticipated-content segment appears in a particular context within said text; and the step of applying the rules includes determining which of said plurality of recordings to select based at least in part on said particular context.

* * * * *